US005207373A

United States Patent [19]

Tighe

[11] Patent Number: 5,207,373

[45] Date of Patent: May 4, 1993

[54] REMAILABLE POSTCARD CARD

[76] Inventor: John F. Tighe, Rabbit Hill, Drawer 1086, Truro, Mass. 02666

[21] Appl. No.: 889,855

[22] Filed: May 28, 1992

Related U.S. Application Data

[63] Continuation-in-part of Ser. No. 701,797, May 17, 1991, Pat. No. 5,118,031.

[51] Int. Cl.[5] ..... B65D 27/06; B42D 15/04

[52] U.S. Cl. ..... 229/92.8; 229/300; 229/305

[58] Field of Search ..... 229/92.8, 300, 305; 283/101, 106

[56] References Cited

U.S. PATENT DOCUMENTS

| | | | |
|---|---|---|---|
| 263,347 | 8/1882 | Mead | 229/92.8 |
| 884,701 | 4/1908 | Borden | 229/92.8 |
| 1,311,397 | 7/1919 | Herter | 229/92.8 |
| 3,329,333 | 7/1967 | Ormond | 229/92.8 |
| 4,278,199 | 7/1981 | Tanaka | 283/101 |
| 4,749,124 | 6/1988 | Bazan | 229/92.8 |
| 4,872,705 | 10/1989 | Hartfeil | 229/92.8 |
| 5,118,031 | 6/1992 | Tighe | 229/92.8 |

FOREIGN PATENT DOCUMENTS

| | | | |
|---|---|---|---|
| 835198 | 12/1938 | France | 229/92.8 |
| 35704 | 11/1905 | Switzerland | 229/92.8 |
| 260134 | 10/1926 | United Kingdom | 229/73 |

*Primary Examiner*—Stephen P. Garbe
*Attorney, Agent, or Firm*—Connolly & Hutz

[57] ABSTRACT

A remailable postcard includes a front side and a back side. The front side would be used in the initial mailing to indicate the original addressee and contain the necessary postage. The back side would have the portion indicating the address of the return addressee. In addition, return postage would be provided on the back side. The return addressee portion would be at least partially covered by a removable label or flap. The card also contains a tear off strip along the edge having the original postage. When the original addressee wishes to return the card the label or flap would be removed to expose the return addressee information and the tear off strip would be detached to remove the original postage. The back side of the card would then contain the necessary postal information to permit the card to be remailed.

12 Claims, 5 Drawing Sheets

REMAILABLE POSTCARD CARD

CROSS-REFERENCE TO RELATED APPLICATION

This application is a continuation-in-part of application Ser. No. 701,797, filed May 17, 1991, now U.S. Pat. No. 5,118,031.

BACKGROUND OF THE INVENTION

The present invention relates to remailable postcards with reply cards attached, particularly those used in direct mail advertising and sales. Generally, such direct mail is used to contact prospective purchasers in an attempt to solicit information or sales in connection with the products, services or other activities of the direct mailer. It is particularly desirable if the remailability of such postcards could be made as convenient as possible by creating a single remailable card so that there will be little difficulty in the prospective customer returning the postcard. There presently exists a wide variety of types of postcards including, for example, multiple attached cards wherein one or more cards must be detached before the returnable card can be sent back to the original mailer. Such cards, by their nature, are not particularly convenient to use.

It would be desirable if a single remailable postcard could be provided which is simple in form and requires only minor manipulations by the original recipient to have the card returned.

SUMMARY OF THE INVENTION

An object of this invention is to provide a remailable postcard which meets the above needs.

A further object of this invention is to provide such a remailable postcard which can be conveniently returned to the sender by the original recipient simply being required to make minor physical alterations to the card.

A still further object to this invention is to provide such a remailable postcard which would qualify for major rate discounts in its postage.

In accordance with this invention the remailable postcard includes a front side which would contain the address of the original recipient as well as the necessary postage. In addition, the front side and/or back side could contain the information intended to be communicated to the recipient. The back side of the postcard includes additional postage and a portion of the back side includes the address of the sender. That portion, however, is initially covered by a detachable label or flap so that during the original mailing only the original recipient's address will prominently appear on the front side of the card. The card would also include a detachable stub or strip along the edge having the outbound posted indicia. The detachable label or flap may be rectangular or triangular. If a flap is used it may be connected to the edge having the detachable strip and covering substantially the entire back side. When the original recipient desires to return the card to the sender, all that is necessary is to remove the label or flap to expose the original sender's address and to detach the edge strip to remove the outbound postal indicia. The result is that the back side of the card then includes the necessary postage and the address of the sender.

If desired, the removable label or flap could also, at least partially, conceal the return postage indicia. In a preferred practice of the invention, bar codes could be provided on both sides of the card to qualify for major rate discounts in both directions. The original postage and bar code may be on the detachable strip.

THE DRAWINGS

DETAILED DESCRIPTION

Figure 1:
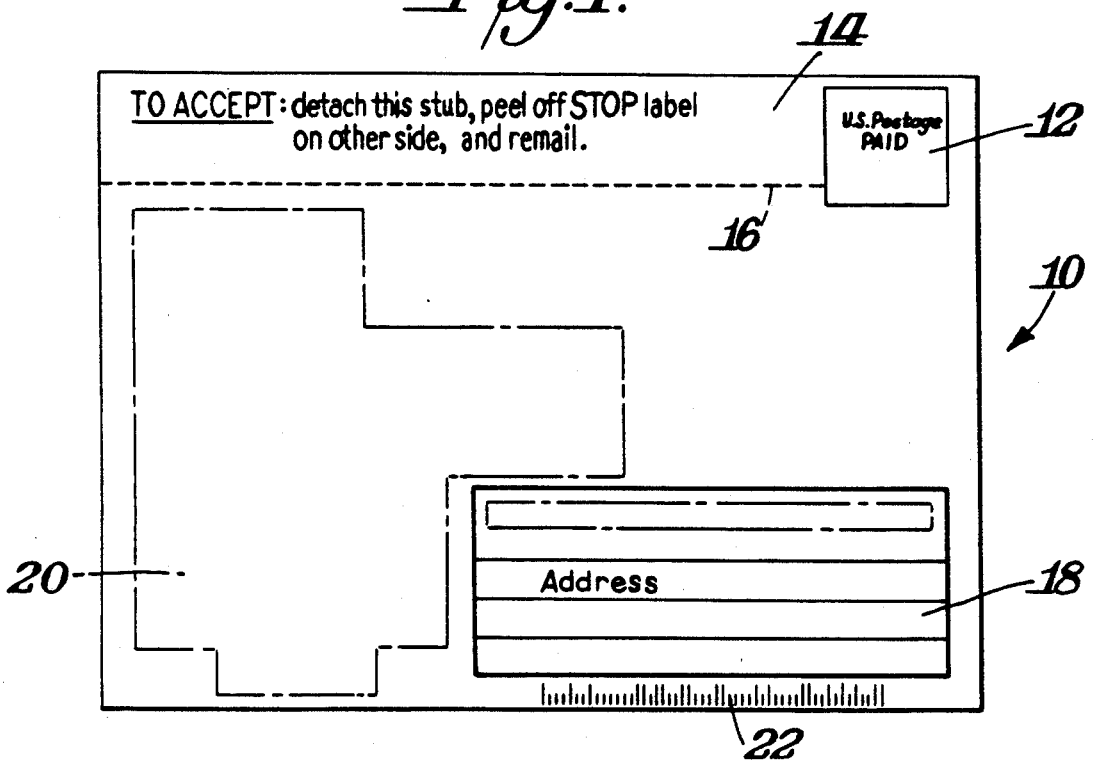
FIG. 1 is a plan view of the front side of a remailable postcard in accordance with this invention.

The drawings illustrate a remailable card 10 in accordance with this invention. FIG. 1 illustrates the front side of the card in its condition when being sent to the original addressee. As shown therein, the outbound postal indicia 12 is provided along the upper edge of the card on part of a detachable edge strip 14 having, if desired, a perforation line 16 to facilitate detachment of edge strip 14 as later described. In addition, the front side includes a portion 18 which contains the address information of the original recipient. The front side may also include a portion 20 containing the information which is intended to be communicated to the recipient. As also shown in FIG. 1, a bar code 22 is provided at any suitable location to qualify for major rate discounts. If desired bar code 22 may be located on strip 14 or remote from strip 14, as illustrated.

Figure 2:
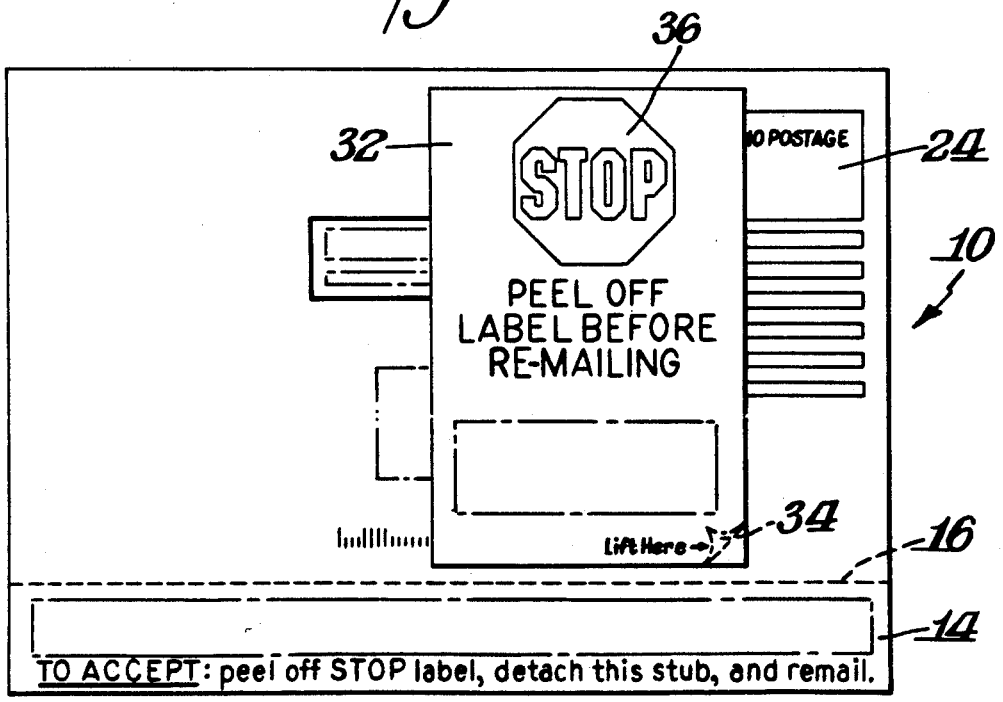
FIG. 2 is a plan view of the back side of the card shown in FIG. 1.
Figure 3:
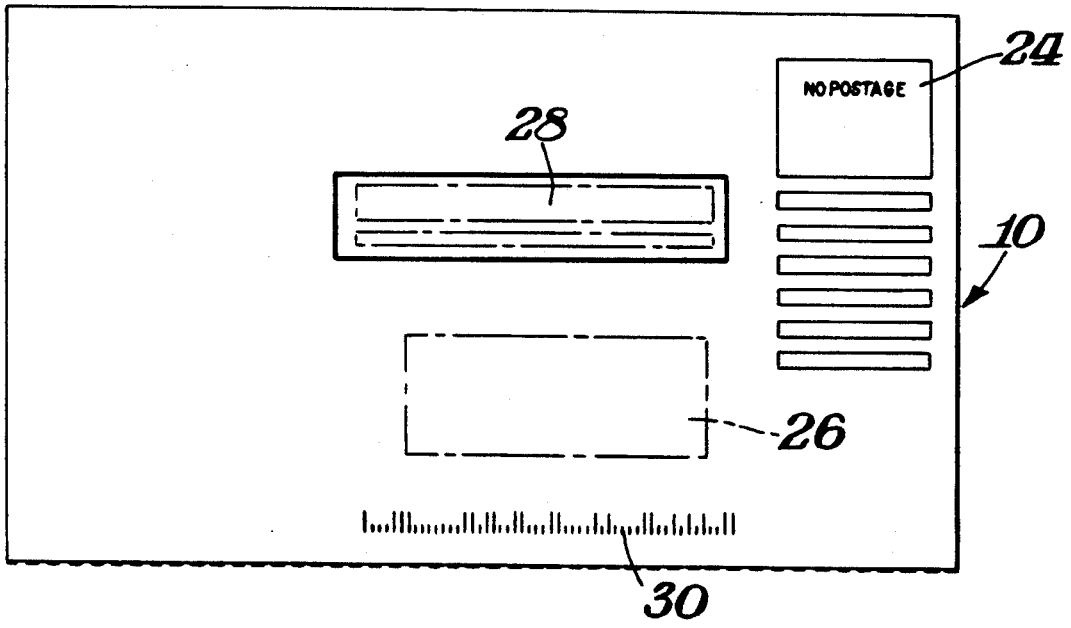
FIG. 3 is a plan view of the back side of the card shown in FIGS. 1–2 in a condition for remailing with the strip removed.

FIGS. 2–3 illustrate the back side of the card 10. As shown therein, the back side also includes postage indicia 24 on the corner diagonally opposite indicia 12. The location of indicia 24 is not critical except that it should not be on strip 14. Thus indicia 12 and 24 could be in corners on the same end of card 10 and not on diagonally opposite corners. In the illustrated embodiment, detachable strip 14 is located on the bottom of the back side when viewed in the proper position for reading by the recipient. As best shown in FIG. 3 the back side further contains the sender's address information in portion 26 of the card. A further portion 28 may contain other information such as an indication that this is a business reply mail with the indication of the permit number and any other necessary information. If desired, the back side might also contain information intended to be communicated to the original recipient. A bar code 30 is also provided on the back side to qualify the postcard for major rate discounts in the return mailing direction.

An important feature of this invention is illustrated in FIG. 2. This feature includes the provision of a peel off label 32 which would cover the business reply side of the postcard containing, for example, the information in areas 26 and 28. If desired, peel off label 22 may also cover at least part of the return postage indicia 24. Peel off label 32 could be applied in any conventional manner such as by means of an easily removable adhesive. In the preferred practice of this embodiment of the invention a portion 34 of peel off label 32 would be made more readily detachable than the remainder of the label to provide a means of grasping the label to facilitate its removal. As illustrated, peel off label 32 would contain directions to the original addressee so that the original addressee would readily know how to use card 10. For example, peel off label 32 might include a prominent stop sign 36 made in the familiar red octagonal shape with the word "stop". Additional instructions such as indicated would also be provided so that the recipient would know that label 32 must be removed before remailing. FIG. 2 further illustrates the indication "lift here" at the corner 34. Similarly, instructions would be provided on strip off stub 14. FIG. 1 illustrates such instructions to include advising the original recipient that if the offer made on card 10 is to be accepted stub 14 should be removed as well as peel off label 32. The same type of instructions are preferably provided on the back side of stub 14.

Peel off label 32 may be of rectangular shape as in the parent application or may be of any other shape, such as a circle. What is important is that peel off label be of a size and strategic location to make clear that the information on the back side of card 10 is not intended to be the original address information while label 32 remains on card 10. Thus, preferably peel off label 32 would cover the sender's address information in portion 26 and may also cover a portion of the bar code 30 and if desired may cover some portion of return postage indicia 24.

Card 10 may be made of any suitable dimensions, such as 3 inches by 5 inches or 6 inches by 9 inches or 9 inches by 12 inches. An additional feature of the invention is that peel off stub or strip 14 might also function as a coupon which could be used by the original recipient for claiming such prize or obtaining samples, etc. from the sender. Thus, detachable strip 14 has the multiple functions of removing the outbound postage indicia and also being usable as a coupon.

In use if the recipient intends to return card 10 to the sender, label 32 would be removed by grasping portion 34 and simply peeling off label 32. Stub 14 would be removed by tearing at the perforated line 16. As is apparent from FIG. 1 the result of removing stub 14 would be to also remove the outbound postage indicia 12. The result of the removable strip 14 and label 32 is clearly shown in FIG. 3 wherein the back side of card 10 is of standard postcard format which would include the necessary postal indica 32 and the sender's address 26 displayed as the intended address. The back side would also be sufficiently thick to meet postal requirements. If necessary such thickness could result from multi-layers.

As is apparent card 10 thus provides a particularly convenient structure and format which requires very little effort by the original recipient to remail the card.

Figure 4:
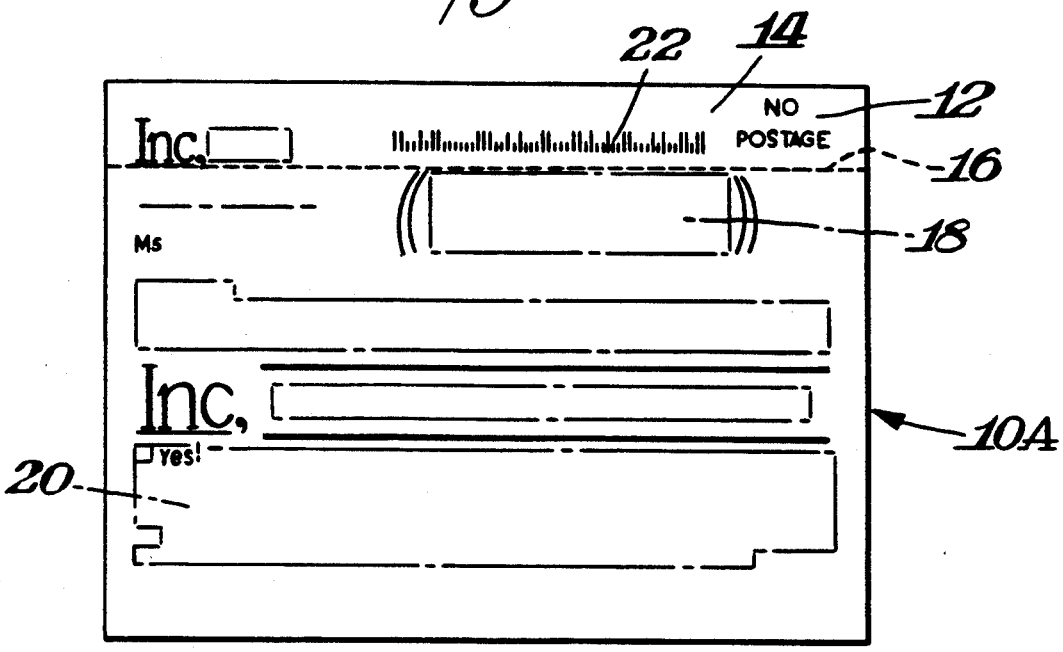
FIG. 4 is a plan view of the front side of a remailable postcard in accordance with a further embodiment of this invention.
Figure 5:
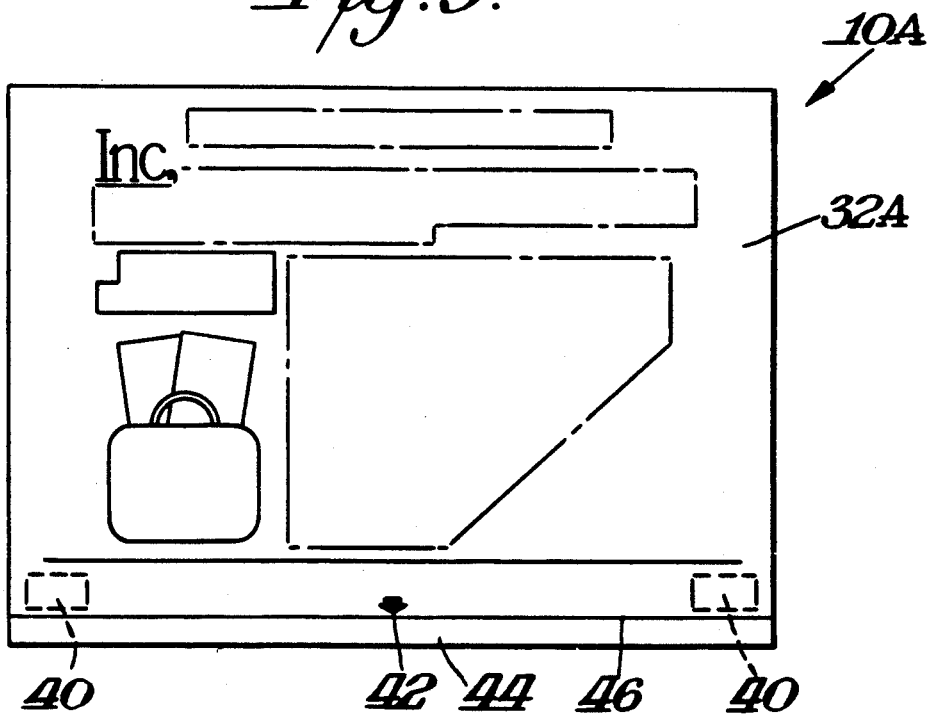
FIG. 5 is a plan view of the back side of the card shown in FIG. 4.
Figure 6:
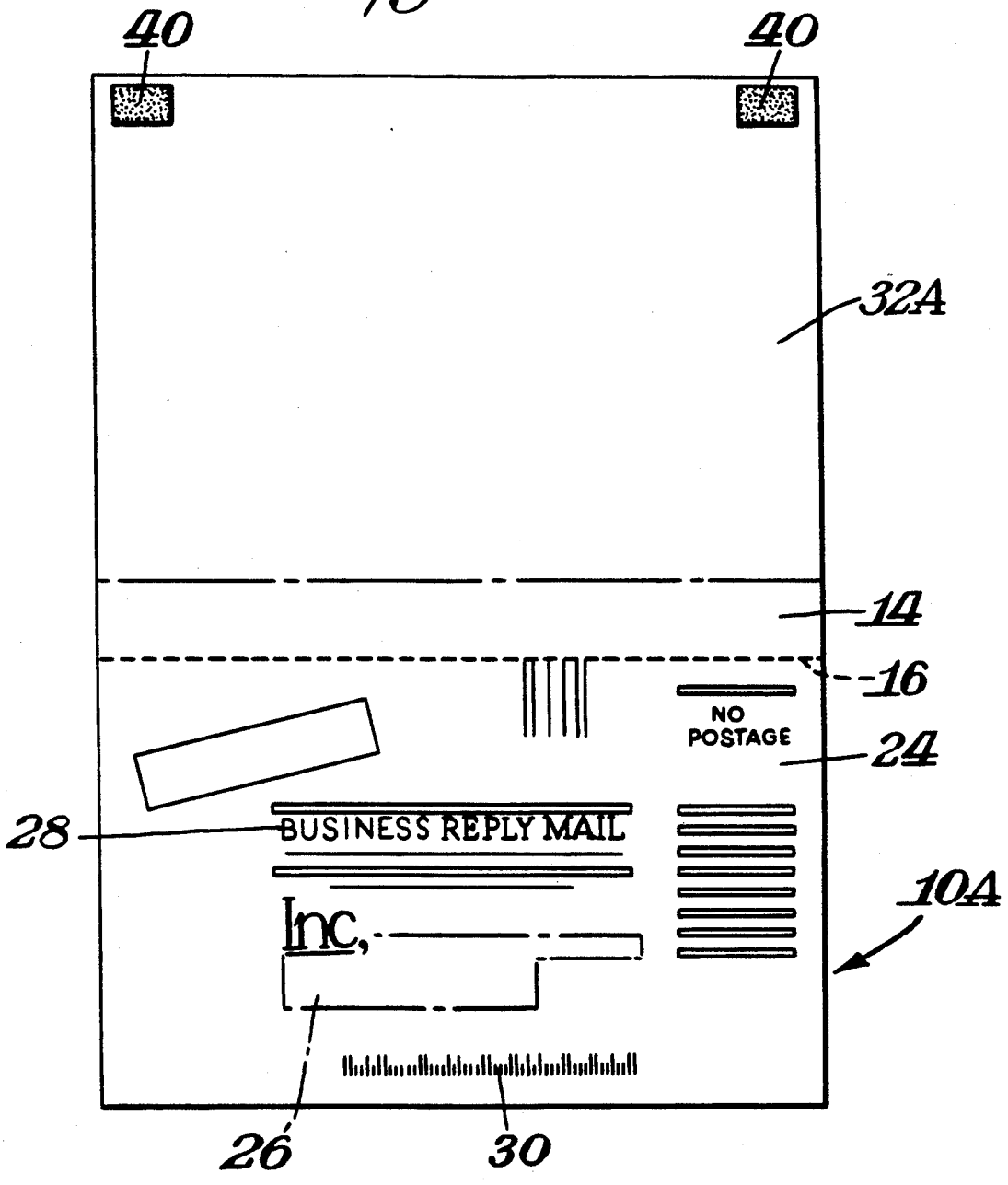
FIG. 6 is a plan view showing the card of FIG. 4–5 in its opened condition.

FIGS. 4–6 illustrate a further embodiment of this invention wherein the postcard 10A includes a front side generally along the same lines as the front side of FIGS. 1–3. Thus the front side includes original postage indicia 12 on strip 14 with a perforation line 16. The original address information 18 would also be included as well as the information portion 20. In FIG. 4, a variation is illustrated where the bar code 22 is located at the top of card 10A on strip 14 near postage indicia 12.

The main difference between the embodiment of FIGS. 4–6 and that of FIGS. 1–3 is that instead of a label 32 which conceals only portions of the back side as in FIGS. 1–3, the embodiment of FIGS. 4–6 include a flap 32A. Flap 32A is formed integral with the edge of the strip 14 at the front side of card 10A and covers substantially the entire back side of card 10A. Adhesive tabs 40 or any other suitable detachable connecting means is used to maintain flap 32A in its closed condition. As shown in FIG. 5 flap 32A could include an indicator, such as arrow 42 to indicate to the recipient where the flap should be lifted. As also illustrated in FIG. 5 a small margin 44 of the back side would be exposed to provide a convenient area for the recipient to insert the finger in lifting flap 32A. It is to be understood, however, that if desired the edge 46 of flap 32A may extend completely to the corresponding edge of the back side of card 10A.

As shown in FIG. 6 when flap 38 is lifted away from the back side of card 10A the back side is then exposed. The return postage indicia 24, the sender's address information 26, the business reply portion 28 and bar code 30 are thereby visible. When the recipient tears card 10A at perforation line 16 the remainder of the card 10A is in a condition for remailing.

Figure 7:
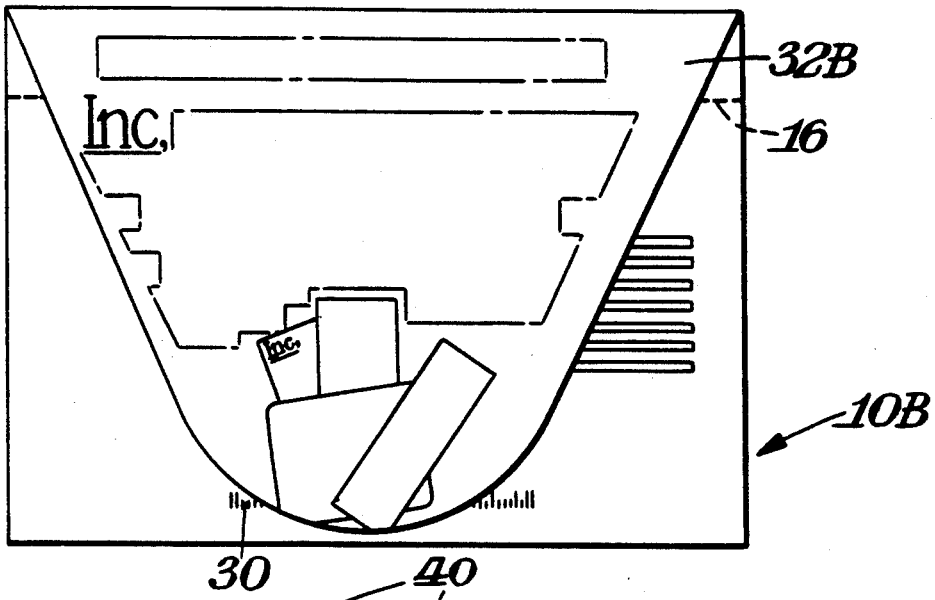
FIG. 7 is a plan view of the back side of a card in accordance with yet another embodiment of this invention.
Figure 8:
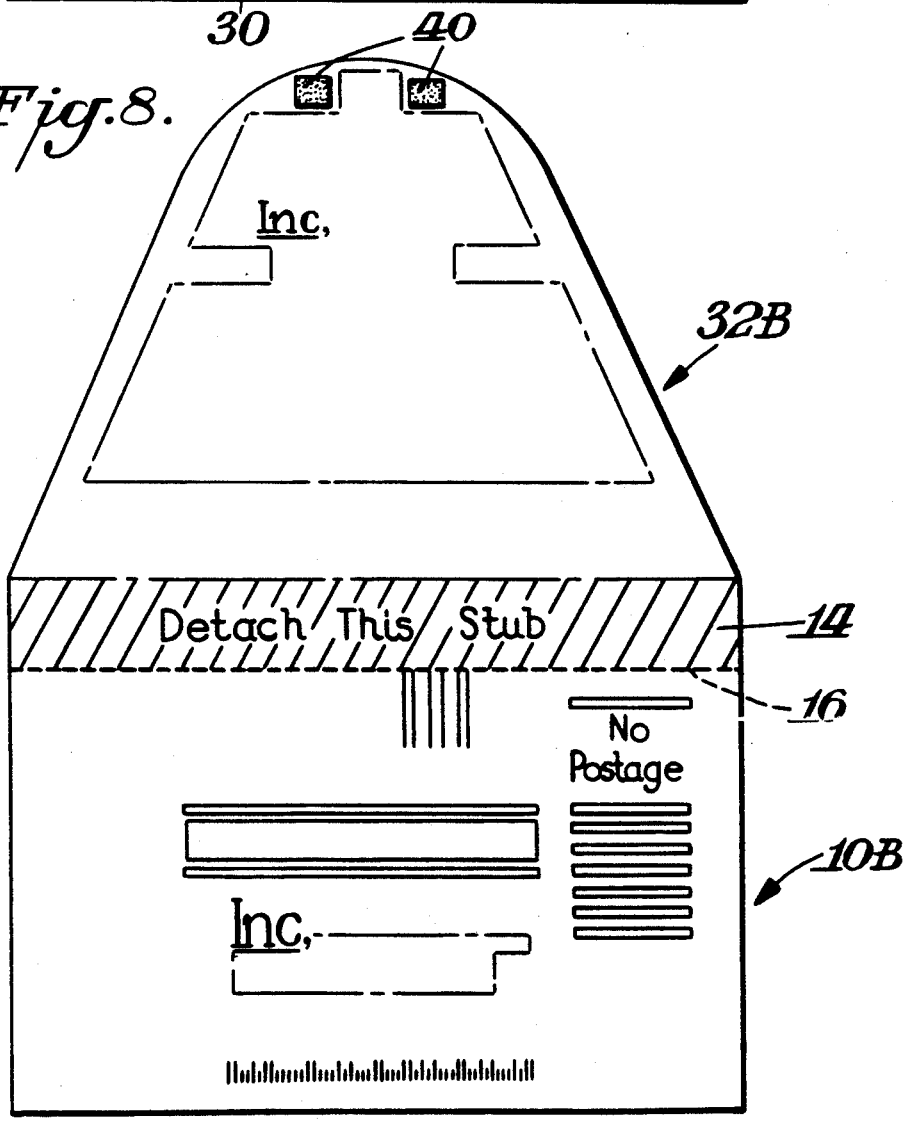
FIG. 8 is a plan view of the card shown in FIG. 7 in its opened condition.

FIGS. 7 and 8 illustrate yet another embodiment of this invention wherein the card 10B is formed along the same lines as card 10A except that the flap 32B is of generally triangular shape of the type customarily used with envelopes. As illustrated therein the triangular shape would have three corners. Two of the corners adjacent to the strip 14 would be anchored corners since they are located on the portion of the flap 32B which is anchored to strip 14. The other corner having adhesive tabs 40 would be a remote corner. As shown in FIG. 7 the remote corner would extend substantially to the edge of the backside of card 10B remote from the anchored corners.

The use of flaps, such as flaps 32A and 32B instead of a peel off label has a number of advantages. For example, the relatively large size of the flaps assures that there will be no confusion as to which side is the outgoing mailing side. In this respect, the use of a flap conceals substantially the entire back side of the card, thus assuring that such information as the postal indicia and sender's address are concealed. Additionally, the flap provides a greater area to the sender on which to include information directed to the recipient.

What is claimed is:

1. A remailable postcard having a front side and a back side, said front side including outbound postage indicia in one corner thereof, a detachable strip along an edge of said card, said outbound postage indicia being located at least partially on said detachable strip, an original recipient's address on said front side, at least a portion of one of said front side and said back side containing information directed to the original recipient, said back side of said card containing postage indicia along a portion of said card distinct from said detachable strip, a portion of said back side including the sender's address, and a removable flap secured to said detachable strip and at least partially covering said sender's address and at least partially covering said postage indicia whereby said card may be remailed by removing said flap and said detachable strip.

2. The card of claim 1 wherein said strip extends completely across front side of said card and includes a perforated line to facilitate its detachability.

3. The card of claim 1 wherein said removable flap includes a portion which functions as a handle means.

4. The card of claim 1 wherein a bar code is provided on at least one side of said card.

5. The card of claim 4 wherein said flap completely conceals said postage indica on said back side.

6. The card of claim 1 wherein bar codes are provided on both sides of said card.

7. The card of claim 1 wherein said flap conceals substantially all of said back side.

8. The card of claim 7 wherein said flap is rectangularly shaped.

9. The card of claim 1 wherein said flap is generally triangularly shaped.

10. The card of claim 9 wherein said generally triangularly shaped flap includes a pair of anchored corners and a remote corner, and said remote corner extending substantially to the edge of said back side remote from said anchored corners.

11. The card of claim 1 wherein said flap contains information directed to the original recipient.

12. The card of claim 1 wherein said flap is integral with said detachable strip.

* * * * *